US005819987A

United States Patent [19]

Miller

[11] Patent Number: 5,819,987

[45] Date of Patent: Oct. 13, 1998

[54] SPRAYER ASSEMBLY FOR SIMULTANEOUSLY DISPENSING MULTIPLE FLUIDS FROM NESTED CONTAINERS

[75] Inventor: Allen D. Miller, Racine, Wis.

[73] Assignee: S. C. Johnson & Son, Inc., Racine, Wis.

[21] Appl. No.: 717,311

[22] Filed: Sep. 20, 1996

[51] Int. Cl.[6] ..... B67D 5/42

[52] U.S. Cl. ..... 222/135; 222/137; 222/145.5; 222/381; 222/383.1; 222/385

[58] Field of Search ..... 222/135, 137, 222/145.1, 145.5, 145.6, 255, 321.1, 321.7, 321.8, 321.9, 381, 383.1, 383.3, 385; 239/333

[56] References Cited

U.S. PATENT DOCUMENTS

| | | | |
|---|---|---|---|
| 3,760,986 | 9/1973 | Castner et al. | 222/137 |
| 4,355,739 | 10/1982 | Vierkotter | 222/383.1 X |
| 4,961,520 | 10/1990 | White | 222/135 |
| 5,152,461 | 10/1992 | Proctor | 239/333 X |
| 5,339,990 | 8/1994 | Wilder | 222/135 |
| 5,385,270 | 1/1995 | Cataneo et al. | 222/137 X |
| 5,398,846 | 3/1995 | Corba et al. | 222/145.5 X |
| 5,402,916 | 4/1995 | Nottingham et al. | 222/383.1 X |
| 5,439,141 | 8/1995 | Clark et al. | 222/383.1 X |
| 5,472,119 | 12/1995 | Park et al. | 222/383.1 X |

*Primary Examiner*—Kenneth Bomberg

[57] ABSTRACT

An apparatus for dispensing multiple fluids from nested containers, while simultaneously venting the fluid containers, includes a first container for containing a first fluid, a second container, nested within the first container, for containing a second fluid, and a manually operable pump for pumping fluid from the containers to dispense a mixture of the fluids from the apparatus. The pump includes (i) a pump actuator for actuating and deactuating the pump, (ii) a reciprocating fluid conduit, which reciprocates upon actuation and deactuation of the pump actuator and (iii) a discharge nozzle for dispensing the mixture of the fluids from the apparatus upon actuation of the pump. The apparatus also includes a mixing chamber for mixing the first and second fluids drawn from the first and second containers, respectively, a fluid transfer conduit for withdrawing fluid from the first container into the mixing chamber and a fluid transfer mechanism for withdrawing fluid from the second container into the mixing chamber, the fluid transfer mechanism including an auxiliary pump, attached to the reciprocating conduit, for pumping fluid from the second container to the mixing chamber upon a corresponding reciprocation of the reciprocating conduit.

24 Claims, 4 Drawing Sheets

SPRAYER ASSEMBLY FOR SIMULTANEOUSLY DISPENSING MULTIPLE FLUIDS FROM NESTED CONTAINERS

BACKGROUND OF THE INVENTION

1. Field of the Invention

The present invention relates to the field of fluid dispensers and especially to a sprayer assembly for simultaneously dispensing multiple fluids from nested containers, for example, for dispensing a dilutable concentrate with a diluent or carrier, which are ejected or sprayed through a nozzle of the sprayer assembly just after being mixed. The concentrate container can be nested within the diluent or carrier container. The fluids are dispensed by a simple pumping and transfer system in a balanced manner from the nested containers, while the containers are simultaneously vented.

2. Description of the Related Art

It is desirable to simultaneously dispense more than one type of fluid from multiple fluid containers of a sprayer assembly. This is especially true when the fluids to be dispensed contain some active ingredients that are incompatible when these ingredients are mixed together in a single solution, yet it is desired to dispense both fluids with their active ingredients simultaneously. One fluid might be water and the other a concentrate, such as insecticide, pesticide or a hard surface cleaner, for example. Alternatively, one container might hold a fluid with an active ingredient, which the fluid in the second container would deactivate. Examples of such pairs of fluids could be a cleaning composition and a bleach, or a pair of stain removing compositions, one an aqueous composition and the other a high-solvent level enzyme containing composition. Whatever the pair of fluids, they are intended to be dispensed simultaneously and in a fixed ratio to each other, the ratio being set either by the design of the system itself, as discussed below, or by some sort of flow adjustment means, as is known in the art. This fixed ratio may be 1:75, 1:50, 1:30 or 1:20, for example. However, if a concentrate such as an insecticide is used, this fixed ratio may be on the order of 1:250 or 1:500, for example, in which case, it will be necessary to use a flow adjustment device due to the constraints of the system, as will be discussed in more detail below.

Several problems have consistently arisen with conventional dispensing systems of this type. Venting of the containers, without allowing leakage of the fluid contents of a container, has been a consistent and recognized problem. An unaddressed problem with such a dispensing system is achieving and maintaining desired flow rates from the different containers so that the fluids are dispensed in a predeterminedly different ratio.

Generally speaking, as a pump draws fluid from a rigid container, the fluid drawn from that container must be replaced by air (venting) for pumping to continue. By contrast, non-rigid containers simply collapse as fluid is drawn from them. When a pumping mechanism draws fluids from two containers simultaneously, and especially when the fluids being pumped from the different containers have different densities or vapor pressures, the degree and speed of venting of the two containers must be almost exactly the same, or a pressure differential is created between the two containers. This is especially true when the differences in densities of the fluids become more distant from each other. This pressure differential causes fluid to be pumped from the two containers at different rates, which tends to exacerbate the pressure differential. It has been found that the "replacement" speed of the venting of the containers must be almost instantaneous to avoid the creation of this pressure differential/ratio problem. The result of this problem is that the desired ratio of the two fluids is not dispensed.

An obvious solution to instantaneous venting is simply to have permanently open vent holes into the fluid containers. This, however, is not a functionally acceptable solution for this type of a dispensing system. Such vent holes would also be leak holes. Fluid leakage through open vent holes would occur when such containers are inadvertently inverted or knocked on their sides. Leakage would also occur if such containers were transported in a low-pressure environment (e.g., the cargo section of an airplane). Additionally, permanently open vent holes would allow vaporization of volatile compounds from within a fluid container. Thus, some means of closing the vent holes is necessary, but the closure mechanism must not in any way impede the flow of air into the container when fluids are being dispensed. Also, the closure mechanism should be relatively simple in construction and inexpensive to manufacture.

While consistency of dispensing is controlled by the venting mechanism of the dispensing apparatus, the ratio of the fluids to be mixed and then dispensed is controlled by the intentional balancing of several interrelated factors: the length and diameters of the dip tubes into the fluid containers, the viscosities and specific gravities of the fluids to be dispensed, the rate of pumping and perhaps, the pumping capacities of the pumps. The pumping capacities of the pumps are dependent upon the diameter of the internal piston or cylinder and the length of the stroke of the pump.

For consistent dispensing of two distinct fluids, excessive commingling of the fluids before they are dispensed must also be prevented. Commingling of the fluids can happen either because the two fluids are brought together in a larger than necessary fluid transfer (mixing) channel or because a pressure differential created between the containers causes siphoning between the containers. To prevent this, a balanced system for dispensing the appropriate amount of fluid from each container must be incorporated into the fluid system of the assembly.

Manually operable (trigger) pumps for use by individuals are necessarily small and lightweight—and therefore have low displacement capacities and low pressure differentials. Available trigger operated spray pumps have been found to pull pressure differentials below approximately 8 psi (550 millibars).

U.S. Pat. No. 5,152,461 ("the '461 patent") to Proctor, "Hand Operated Sprayer With Multiple Fluid Containers" discloses a trigger sprayer dispensing device that selectively draws fluids out from at least two separate containers, mixes the fluids in a desired concentration or ratio and expels the mixture of fluids out of a nozzle. This trigger sprayer is equipped with a metering device for variably controlling the ratio of fluids being mixed. The containers connected to the trigger sprayer are selectively detachable for refilling a container with fluid or exchanging one of the containers with another container having another fluid.

The '461 patent utilizes a piston and cylinder fluid pumping mechanism, which is located near the nozzle outlet. When the piston draws a vacuum within the cylinder, fluid is drawn up from the first and second bottles, through connecting tubings to the cylinder and out the nozzle. The first and second connecting tubings are made of flexible material so that as the piston reciprocates, the tubings flex back and forth with the piston movement. The piston is provided with a disk-shaped diaphragm installed on its downstream end, which acts as a flapper or butterfly type one-way valve. When at rest, the valve provides positive sealing pressure to inhibit fluid leaking from the chamber back into the bottles, and to inhibit siphoning of fluids between the bottles through the chambers.

In the '461 patent, the bottles are individually vented through vent holes having one-way valving mechanisms. The vent holes are provided in tube retainer pieces. Each bottle has its own tube retainer piece, and hence, its own vent hole.

To prevent fluid from undesirably leaking out through the vent holes, the venting mechanisms comprise tubular-shaped retainer seals that act as one-way valves. Each bottle likewise has its own retainer seal.

Accordingly, the '461 patent recognizes the need to vent the bottles, but provides a complicated valving arrangement to do so. The dispensing mechanism, with its own separate butterfly-type valve, adds to the complexity of the device in the '461 patent. Such a complex system can be difficult and expensive to manufacture. These costs will be passed on to the consumer. Further, such a complex valving arrangement can fail for one reason or another, for reasons such as those discussed above.

Further, while the '461 patent recognizes the need for venting the bottles, that patent does not recognize the need for instantaneously venting of the bottles upon dispensing of the fluids. Rather, venting is independent for each bottle and a finite or minimum "cracking" pressure is required to open a respective vent hole. Thus, a predeterminedly minimum negative pressure or partial vacuum must be generated in each bottle to open a respective vent hole. With this arrangement, any small differences in the negative pressure necessary to open a respective vent hole will magnify the pressure differentials in dispensing the fluids. This will exacerbate any problems in maintaining a desired dispensing ratio, and can cause premature siphoning of the fluid in one of the containers.

Other systems, known in the art, are especially deficient in one or more respects.

U.S. Pat. No. 4,355,739 ("the '739 patent") to Vierkotter, "Fluid Storage Container" discloses a fluid storage container that can be connected or attached to a spray pump and includes two separate chambers for holding separate fluids. Each chamber has a take-up tube which leads to a mixing chamber contained within a movable sleeve attached to a movable, external selector. When the external selector is moved, the movable sleeve, attached thereto, moves such that the ratio of the quantities of fluids from the chambers is varied.

U.S. Pat. No. 5,339,990 ("the '990 patent") to Wilder, "Adjustable Pump Dispenser" discloses a pump dispenser in which fluids are segregated into separate chambers within a common container. The chambers are formed by fabricating the container in an hourglass design, dividing the container into upper and lower portions. The chambers are serviced by separate pumps, which draw the constituent fluids independently and deliver them through a common outlet. The chambers are isolated from one another by inserting the pump servicing the lower chamber through the upper chamber and fitting it snugly into the waist of the hourglass. The pumps servicing the upper and lower chambers move in tandem and are fixed together by a common pump head. The pump head also serves as the outlet through which the constituent fluids are delivered. Fluid is delivered in fixed quantities from the lower chamber via an elongated pump mechanism. Fluid is delivered in adjustable quantities from the upper chamber via a modified pump design. This modified design permits the normal delivery of the constituent fluid, recirculation of fluid back into the upper chamber, or both.

U.S. Pat. No. 5,402,916 ("the '916 patent") to Nottingham, et al., "Dual Chamber Sprayer With Metering Assembly" discloses a hand-actuated multiple container trigger sprayer that includes a sprayer head assembly removably connected to a plurality of fluid containers. The sprayer head assembly has an outer housing, a nozzle attached to the housing, a pump mechanism enclosed within the housing and tubing fluidly connecting each of the plurality of fluid containers with the pump mechanism in the housing. A trigger or lever actuates the pump mechanism to draw fluid through the tubing from each of the plurality of fluid containers and to discharge the fluid through the nozzle. A metering device is located between the fluid containers and the pump mechanism and is accessible externally from the housing to selectively control the amount of fluid from the containers. The metering device includes flow paths to the pump mechanism for each of the fluid containers. The diameter and length of at least one of the flow paths can be controlled using a metering valve to selectively control the amount of fluid drawn from the fluid containers.

U.S. Pat. No. 5,439,141 ("the '141 patent") to Clark, et al., "Dual Fluid Spraying System" discloses a manifold for use with a hand held pump spray device that allows the spray head to draw simultaneously from two separate reservoirs containing two different fluids, such that the spray head raises a mixture of the two fluids in a predetermined ratio. The manifold includes at least one ball check valve arrangement in the suction line to the chemical concentrate reservoir, the ball check valve being normally biased to a closed position. The check valve prevents the pumping of the concentrate when the diluent reservoir is spent and further prevents cross-contamination between the fluids in the two reservoirs due to siphoning. FIGS. 10 and 11 of the '141 patent show a concentrate bottle located within a water bottle. However, the '141 patent makes no mention of separate valving or pumping mechanisms for the respective bottles, but rather, relies solely on the hand held pump spray device for controlling the dispensing of fluids from these separate bottles.

U.S. Pat. No. 5,472,119 ("the '119 patent") to Park, et al., "Assembly for Dispensing Fluids from Multiple Containers, While Simultaneously and Instantaneously Venting the Fluid Containers," assigned to the same assignee as the subject application, discloses a spray bottle combination for dispensing fluids from multiple containers, while simultaneously and instantaneously venting the fluid containers. The combination includes at least two fluid containers, a sprayer mechanism, including a sprayer actuator, for pumping fluid from the containers to dispense the fluid, a manifold and a fluid transfer mechanism. One end of the manifold is connected to an outlet end of each of the fluid containers. The manifold provides at least one fluid discharge opening and at least one vent opening for each container. The fluid transfer mechanism provides fluid communication between the fluid discharge openings of the manifold and the sprayer mechanism. The fluid transfer mechanism includes a valve arrangement, engageable with another end of the manifold, for simultaneously opening and closing the fluid discharge openings and air passage to and from the vent openings of the manifold upon a corresponding pumping actuation and deactuation of the sprayer actuator.

Each of the foregoing designs has one drawback or another, whether it be in the complexity of the overall system design or in the venting or dispensing mechanisms. Accordingly, a need has arisen for a sprayer assembly, which addresses the problems with the foregoing designs, by providing the ability to simultaneously dispense multiple fluids, such as diluent and a concentrate, for example, from nested containers using a simple venting and pumping arrangement.

SUMMARY OF THE INVENTION

The present invention has been made in consideration of the above-described problems in the prior art.

It is an object of the present invention to overcome the problems with the prior art discussed above, and to provide a sprayer assembly for dispensing multiple fluids from nested containers, while simultaneously venting the fluid containers. The dispensing assembly of the present invention is relatively simple in design, and hence, to manufacture.

A further object of this invention is to provide such a dispensing system that achieves a stable ratio of dispensing fluids by means of a venting system that allows simultaneous, non-impeded venting of the containers to the ambient atmosphere during pumping of fluid from the containers.

Yet another object of the invention is to provide such a dispensing system that can be transported and stored without danger of leakage or evaporation of its contents.

Still another object of the invention is to provide such a dispensing system that will dispense a mixture of two or more different fluids in a specific and pre-set ratio.

A further object of the invention is to provide such a dispensing system that will prevent premature commingling or siphoning of the distinct fluids to be dispensed.

To achieve these objects, the present invention, in a first aspect, is directed to an apparatus for dispensing multiple fluids from nested containers, while simultaneously venting the fluid containers. The apparatus includes a first container for containing a first fluid, a second container, nested within the first container, for containing a second fluid, and manually operable pumping means for pumping fluid from the containers to dispense a mixture of the fluids from the apparatus. The pumping means includes (i) pump actuation means for actuating and deactuating the pumping means, (ii) a reciprocating fluid conduit, which reciprocates upon actuation and deactuation of the pump actuation means and (iii) a discharge nozzle for dispensing the mixture of the fluids from the apparatus upon actuation of the pumping means.

The apparatus further includes a fluid transfer channel providing a mixing chamber for mixing the first and second fluids drawn from the first and second containers, respectively, a hollow fluid transfer dip tube for the first container, the first container dip tube being connected to the fluid transfer channel and extending into the first container for withdrawing fluid from the first container into the fluid transfer channel upon deactuation of the pumping means, a hollow fluid transfer dip tube for the second container, the second container dip tube extending into the second container for withdrawing fluid from the second container upon deactuation of the pumping means and an auxiliary pump having an auxiliary pump chamber.

The auxiliary pump is connected to the reciprocating fluid conduit of the pumping means and reciprocates upon a corresponding actuation and deactuation of the pump actuation means. The auxiliary pump also is in fluid flow communication with the second container dip tube and the fluid transfer channel. Deactuation of the pumping means fills the auxiliary pump chamber with the second fluid drawn from the second container through the second container dip tube and actuation of the pumping means simultaneously supplies the fluid transfer channel with the second fluid from the auxiliary pump chamber and withdraws a mixture of the first and second fluids from the fluid transfer channel for dispensing the mixture of fluids from the apparatus.

To achieve the above-noted objects, the present invention, in a second aspect, is directed to an apparatus for dispensing multiple fluids from nested containers, while simultaneously venting the fluid containers. The apparatus includes a first container for containing a first fluid, a second container, nested within the first container, for containing a second fluid, and a manually operable pump for pumping fluid from the containers to dispense a mixture of the fluids from the apparatus. The pump includes (i) a pump actuator for actuating and deactuating the pump, (ii) a reciprocating fluid conduit, which reciprocates upon actuation and deactuation of the pump actuator and (iii) a discharge nozzle for dispensing the mixture of the fluids from the apparatus upon actuation of the pump.

The apparatus further includes a mixing chamber for mixing the first and second fluids drawn from the first and second containers, respectively, a fluid transfer conduit for withdrawing fluid from the first container into the mixing chamber and a fluid transfer mechanism for withdrawing fluid from the second container into the mixing chamber, the fluid transfer mechanism including an auxiliary pump, attached to the reciprocating conduit, for pumping fluid from the second container to the mixing chamber upon a corresponding reciprocation of the reciprocating conduit. The first fluid is withdrawn from the first container into the mixing chamber and the second fluid is withdrawn from the second container, upon deactuation of the pump.

In this aspect, the apparatus also includes a fluid transfer conduit for withdrawing fluid from the second container, the auxiliary pump being in fluid flow communication with the second container fluid transfer conduit and the mixing chamber. The auxiliary pump includes an auxiliary pump chamber, and deactuation of the pump fills the auxiliary pump chamber with the second fluid drawn from the second container through the second container fluid transfer conduit and actuation of the pump simultaneously supplies the mixing conduit with the second fluid from the auxiliary pump chamber and withdraws a mixture of the first and second fluids from the mixing chamber for dispensing the mixture of fluids from the apparatus.

In either aspect, the auxiliary pump further includes a stationary piston affixed to the apparatus, the piston being located within the auxiliary pump chamber such that reciprocation of the auxiliary pump upon a corresponding actuation and deactuation of the pump actuation means or the pump actuator draws the second fluid from the second container into the auxiliary pump chamber and then pumps that fluid into the fluid transfer channel or mixing chamber for mixing with the first fluid.

In either aspect, the first container is vented to atmosphere upon actuation of the pumping means or pump, and the apparatus further includes venting means for simultaneously venting the second container, when the first container is vented, upon actuation of the pumping means or pump. The venting means can include a flapper vent provided in an upper portion of the second container, the flapper vent being opened to vent the second container upon a corresponding venting operation of the first container. Alternatively, the venting means includes a duckbill vent provided in an upper portion of the second container. In this arrangement, a vent pin or rod is affixed to the apparatus, the vent pin or rod opening the duckbill vent upon actuation of the pumping means or the pump.

In either aspect, the apparatus further includes a one-way check valve located between the second container dip tube or fluid transfer conduit and the auxiliary pump chamber, for allowing fluid flow of the second fluid from the second container, through the second container dip tube or transfer conduit and into the auxiliary pump chamber. The apparatus also includes a one-way check valve located between the auxiliary pump chamber and the fluid transfer channel or mixing chamber for allowing fluid flow from the auxiliary pump chamber into the fluid transfer channel or mixing chamber.

The first fluid can include a diluent and the second fluid a concentrate, a mixture of which is dispensed from the apparatus in a predetermined ratio upon actuation of the pumping means or the pump.

The above-noted and other objects, advantages and features of the present invention will become more apparent from the following description of the preferred embodiments taken in conjunction with the accompanying drawings.

BRIEF DESCRIPTION OF THE DRAWINGS

Like reference numerals have been used for like or corresponding elements throughout the views.

DETAILED DESCRIPTION OF THE PREFERRED EMBODIMENTS AND BEST MODE FOR CARRYING OUT THE INVENTION

The preferred embodiments and the best mode for carrying out the invention will now be described with reference to the drawings.

Figure 1:
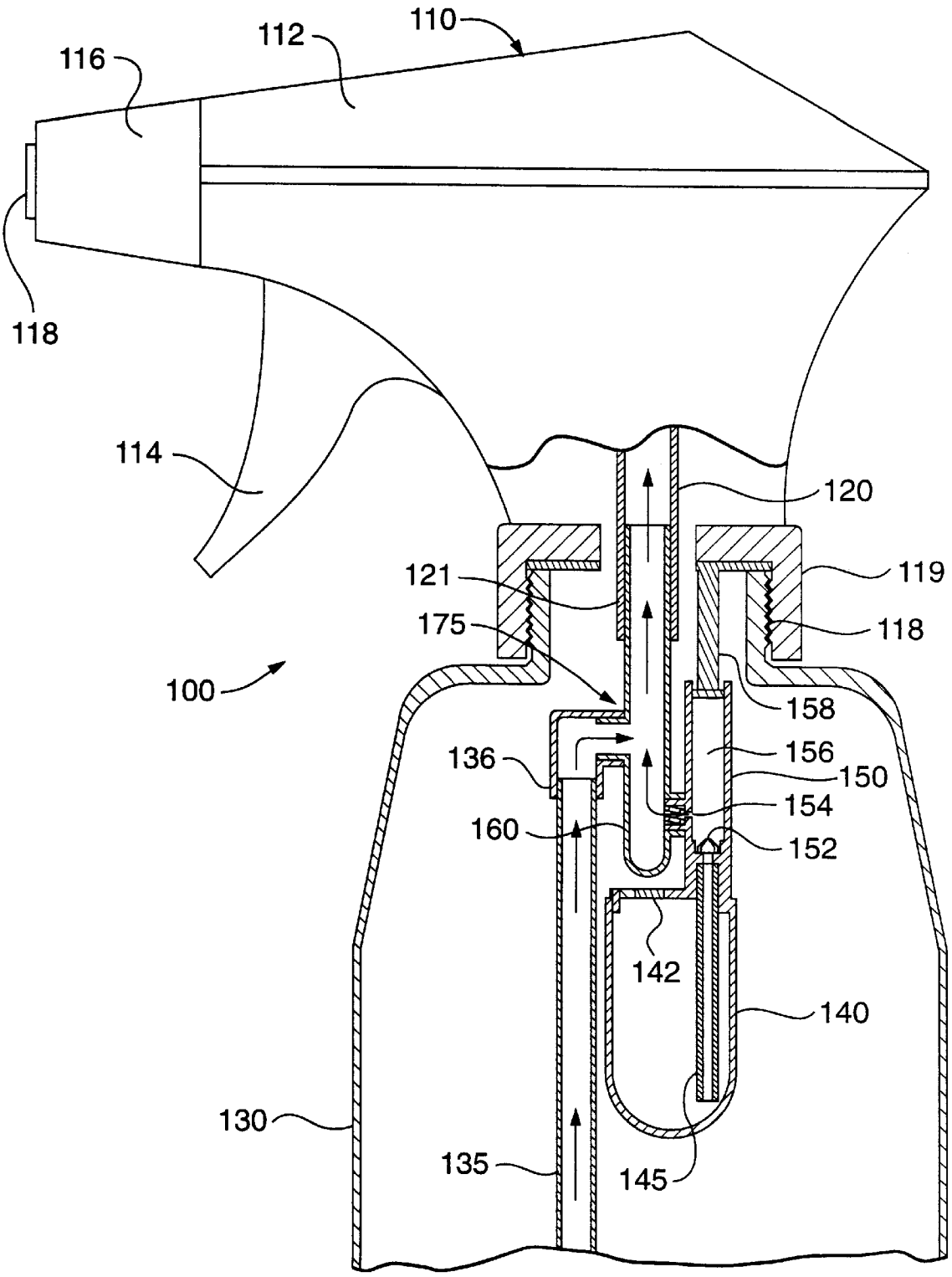
FIG. 1 is a partial cross-sectional view showing the components of a first embodiment of the dispensing assembly of the present invention.

FIG. 1 shows the overall configuration of the fluid dispensing assembly 100 of a first embodiment of the present invention. Fluid dispensing assembly 100 includes, as main components, a trigger sprayer 110, a reciprocating conduit 120, a first container 130 for containing a first fluid, a second container 140 for containing a second fluid, an auxiliary pump 150, and a fluid transfer channel or mixing chamber 160. The reciprocating conduit 120 is part of a pumping mechanism, as will be discussed in more detail below.

The trigger sprayer 110 includes a sprayer head 112, which includes a threaded connector 119 having threads 118 for connecting the trigger sprayer 110 to corresponding threads in the first container 130. The trigger sprayer 110 also includes a trigger 114 which may be manually actuated (squeezed) by a user to dispense a mixture of fluids out of a nozzle 116 through a nozzle tip 118, as will be discussed in more detail below. Trigger sprayer 110 may be any of the manually operated, relatively low displacement types (approximately 0.2 to 1.5 milliliters) available, which utilize a vertically moving or reciprocating conduit 120. For example, a commercial embodiment of trigger sprayer 110 is available from Owens-Brockway Closure and Specialty Products of North Riverside, Ill., as a standard variable spray/low actuation force trigger sprayer. Of course, other trigger sprayers of this type may be used as desired.

In the present invention, then, trigger sprayer 110 is of the reciprocating conduit type in which the reciprocating conduit 120 is spring loaded. This means that, in the present invention, actuation and deactuation of trigger 114 will correspondingly reciprocate spring-loaded, reciprocating conduit 120, to which second container 140, auxiliary pump 150 and fluid transfer channel or mixing chamber 160 are coupled. These elements will collectively be referred to as a fluid transfer mechanism 175. Operation of the dispensing assembly 100 and fluid transfer mechanism 175 of the present invention will be discussed later in more detail. Discussion of the operation of the trigger sprayer 110, however, will be limited, since this operation is known in the art.

For example, as is known in the art, trigger sprayer 110 is of the reciprocating conduit type and utilizes two one-way check valves for dispensing fluids. One valve can be provided at the top of the reciprocating conduit 120, while the other can be located at the end of the fluid discharge conduit (not shown), just upstream of the nozzle tip 118. Fluid that has already been drawn into the trigger sprayer 110 is dispensed upon actuation (squeezing) of the trigger 114 of trigger sprayer 110. Likewise, fluid is drawn into the fluid transfer channel or mixing chamber 160 and reciprocating conduit 120 upon deactuation of trigger 114, for subsequent discharge upon actuating trigger 114. Such operation will be discussed in more detail below.

FIG. 1 shows that second container 140 is nested within the first container 130. In more detail, an advantage to the present invention is that the entire fluid transfer mechanism 175 fits within first container 130, which may be a standard screw-top bottle. Therefore, it is necessary that fluid transfer mechanism 175 be smaller than the inner diameter of the opening of such a bottle. This inner diameter is typically on the order of 13/16 (0.830) inches. Of course, this dimension may change as standards change. Nevertheless, this arrangement allows the fluid transfer mechanism 175 to be readily replaceable and interchangeable from container to container. In this embodiment, fluid transfer mechanism 175 may be affixed to reciprocating conduit 120 at connection 121 using conventional techniques, such as molding, adhesively securing, spot welding and the like. Of course, other techniques known in the art may be utilized. For example, these elements may be screw threaded or otherwise mechanically attached.

As discussed above, trigger sprayer 110 constitutes a manually operable pumping device for pumping fluid from the first container 130 and second container 140 to dispense a mixture of the fluids from the fluid dispensing assembly 100. The pumping device 110 includes (i) a pump actuation device, such as trigger 114, for actuating and deactuating the pumping device, (ii) reciprocating fluid conduit 120, which reciprocates upon actuation and deactuation of the pump actuation device 114 and (iii) discharge nozzle 116 for dispensing the mixture of the fluids from the fluid dispensing assembly 100 upon actuation of the pumping device 110.

FIG. 1 shows that fluid transfer channel or mixing chamber 160 is provided for mixing the first and second fluids drawn from the first container 130 and second container 140, respectively. Hollow fluid transfer dip tubes are provided for each container. In more detail, the first container 130 includes a hollow fluid transfer dip tube 135, which is connected to the fluid transfer channel 160 and extends into the first container 130 for withdrawing fluid from the first container 130 into the fluid transfer channel 160 upon deactuation of the pumping device 110. The second container 140 includes a hollow fluid transfer dip tube 145, which extends into the second container 140 for withdrawing fluid from the second container 140 upon deactuation of the pumping device 110.

FIG. 1 also shows auxiliary pump 150, which includes an auxiliary pump chamber 156. The auxiliary pump 150 is connected to the reciprocating fluid conduit 120 of the pumping device 110 and reciprocates upon a corresponding actuation and deactuation of the pump actuation device 114 and is in fluid flow communication with the second container dip tube 140 and the fluid transfer channel 160.

Figure 2:
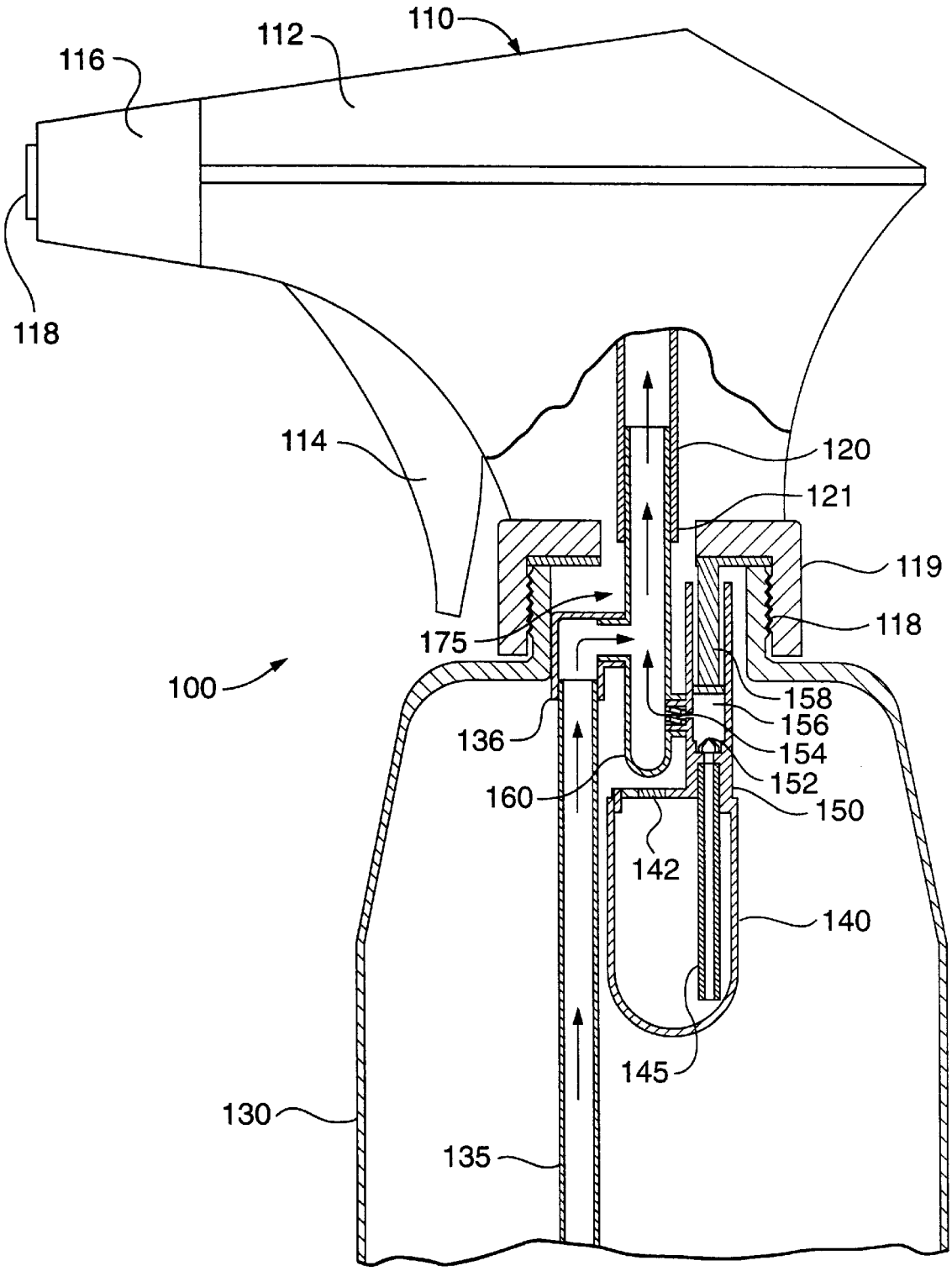
FIG. 2 is a partial cross-sectional view showing the first embodiment of the dispensing assembly of the present invention, in an engaged position.

As shown in more detail with respect to FIGS. 1 and 2, with FIG. 2 showing an engaged position of trigger 114, the auxiliary pump 150 also includes a stationary piston 158 affixed to the fluid dispensing assembly 100. The piston 158 is located within the auxiliary pump chamber 156 such that reciprocation of the auxiliary pump 150 upon a corresponding actuation and deactuation of the pump actuation device 114 draws the second fluid from the second container 140, through dip tube 145, into the auxiliary pump chamber 156 and then pumps that fluid into the fluid transfer channel 160 for mixing with the first fluid, which has been drawn from first container 130 through dip tube 135.

In operation, deactuation of the pumping device 110 fills the auxiliary pump chamber 156 with the second fluid drawn from the second container 140 through the second container dip tube 145. Actuation of the pumping device 110 simultaneously supplies the fluid transfer channel 160 with the second fluid from the auxiliary pump chamber 156 and withdraws a mixture of the first and second fluids from the fluid transfer channel 160 through reciprocating conduit 120 for dispensing the mixture of fluids from the fluid dispensing assembly 100. Accordingly, the entire fluid transfer mechanism 175 reciprocates upon a corresponding reciprocating action of reciprocating conduit 120 upon actuation and deactuation of trigger 114 of trigger sprayer 110.

Based on the design of this system, the first container 130 is vented to atmosphere upon actuation of the pumping device 110. In this regard, merely pulling back trigger 114 will "crack" the system to allow venting of the first container 130. Second container 140 includes a venting device 142 for simultaneously venting the second container 140 when the first container 130 is vented, upon actuation of the pumping device 110. In this embodiment, the venting device 142 comprises a flapper vent provided in an upper portion of the second container 140. The flapper vent is opened to vent the second container 140 upon a corresponding venting operation of the first container 130.

Returning to the discussion of the fluid flow scheme, one-way check valve 152 is located between the second container dip tube 145 and the auxiliary pump chamber 156 for allowing fluid flow of the second fluid from the second container 140, through the second container dip tube 145 and into the auxiliary pump chamber 156. One-way check valve 152 is called a "vertical" check valve since it is arranged vertically in the fluid dispensing assembly 100, and may be gravity seated. Another one-way check valve 154 is located between the auxiliary pump chamber 156 and the fluid transfer channel 160 for allowing fluid flow from the auxiliary pump chamber 156 into the fluid transfer channel 160. One-way check valve 154 is called a "horizontal" check valve, since it is arranged horizontally within the fluid dispensing assembly 100. Check valve 154 must be spring-loaded or otherwise of a self-closing type, since it is horizontally arranged and may otherwise leak.

First container fluid transfer dip tube 135 may be attached to fluid transfer channel 160 using a suitable connector 136. Connector 136 may also be provided with a one-way valving mechanism (not shown) such as a ball, butterfly, flapper, duckbill or other type of one-way check valve. This will prevent commingling of fluids that may otherwise return from the above-noted fluid transfer channel 160. These types of valves may likewise be used for venting device 142 and one-way check valves 152 and 154. Specifically, any suitable one-way check valve known in the art may be utilized in these instances.

The first fluid in first container 130 can be a diluent, such as water and the like, while the second fluid in second container 140 can be a concentrate, for example. A mixture of these fluids is dispensed from the fluid dispensing assembly 100 in a predetermined ratio upon actuation of the pumping device 110. Thus, second container 140 may, for example, be filled with a fluid, such as a concentrated household cleaning fluid, a hard surface cleaner, an insecticide or a pesticide and the like, while first container 130 may, for example, be filled with a diluting fluid, such as water. The fluid dispensing assembly 100 then meters out a mixture of the cleaning fluid diluted with water. This mixture will be at a desired or substantially fixed ratio such as 1:75, 1:50, 1:30 or 1:20, for example. The user will refill or replace the fluid containers, as necessary. Of course, the present invention is not limited to these examples, for any type of fluids, whether used alone or to be mixed in any ratio, may be used as desired. Further, either first container 130 or second container 140 may be subdivided into a number of chambers, which can include the same or different fluids for being dispensed.

We have found that, due to the physical constraints of the auxiliary pump 150, a fixed ratio of 1:50 or 1:75 may be the outside limits, since a very small diameter for the auxiliary pump 150 becomes impractical from a manufacturing standpoint. In this regard, it is only possible to change the inner diameter of the auxiliary pump 150 or the stroke of the stationary piston 158. In some instances, a smaller fixed ratio, on the order of 1:250 or 1:500 may be desired when using an insecticide or a pesticide, for example. In this case, it will be necessary to use a flow adjustment device (not shown), due to the constraints of the system, which have been discussed above. Such flow adjustment devices are known in the art.

The materials of construction of the foregoing elements depend in part upon the type of fluids being dispensed. For example, in an application where the second container 140 is filled with a high concentration cleaning fluid and the first container 130 is filled with water, for example, as a diluting fluid, certain materials may be preferred. For example, the elements contacting either the cleaning fluid or water may be water and solvent resistant materials selected from the group consisting of polyethylene, polypropylene, polyethylene terepthalate (PET) and polyvinyl chloride (PVC). However, the present invention is not limited to such materials. Rather, any suitable material may be used.

In operation, then, when trigger 114 is actuated to dispense fluid, reciprocating conduit 120 will move upwardly, as shown in FIG. 2, and hence, will also move fluid transfer mechanism 175 upwardly. This upward movement will also simultaneously supply the fluid transfer channel 160 with the second fluid from the auxiliary pump chamber 156. When trigger 114 is deactuated, to refill the trigger sprayer 110, reciprocating conduit 120 will move downwardly to draw a vacuum within the fluid dispensing assembly 100. This will withdraw fluid from the first container 130 into the fluid transfer channel 160 and will fill the auxiliary pump chamber 156 with the second fluid drawn from the second container 140 through the second container dip tube 145. Also, as discussed above, when trigger 114 is actuated, first container 130 will be vented to the atmosphere. Simultaneously therewith, second container 140 will be vented through venting device 142. This venting also is instantaneous with a dispensing operation.

Figure 3:
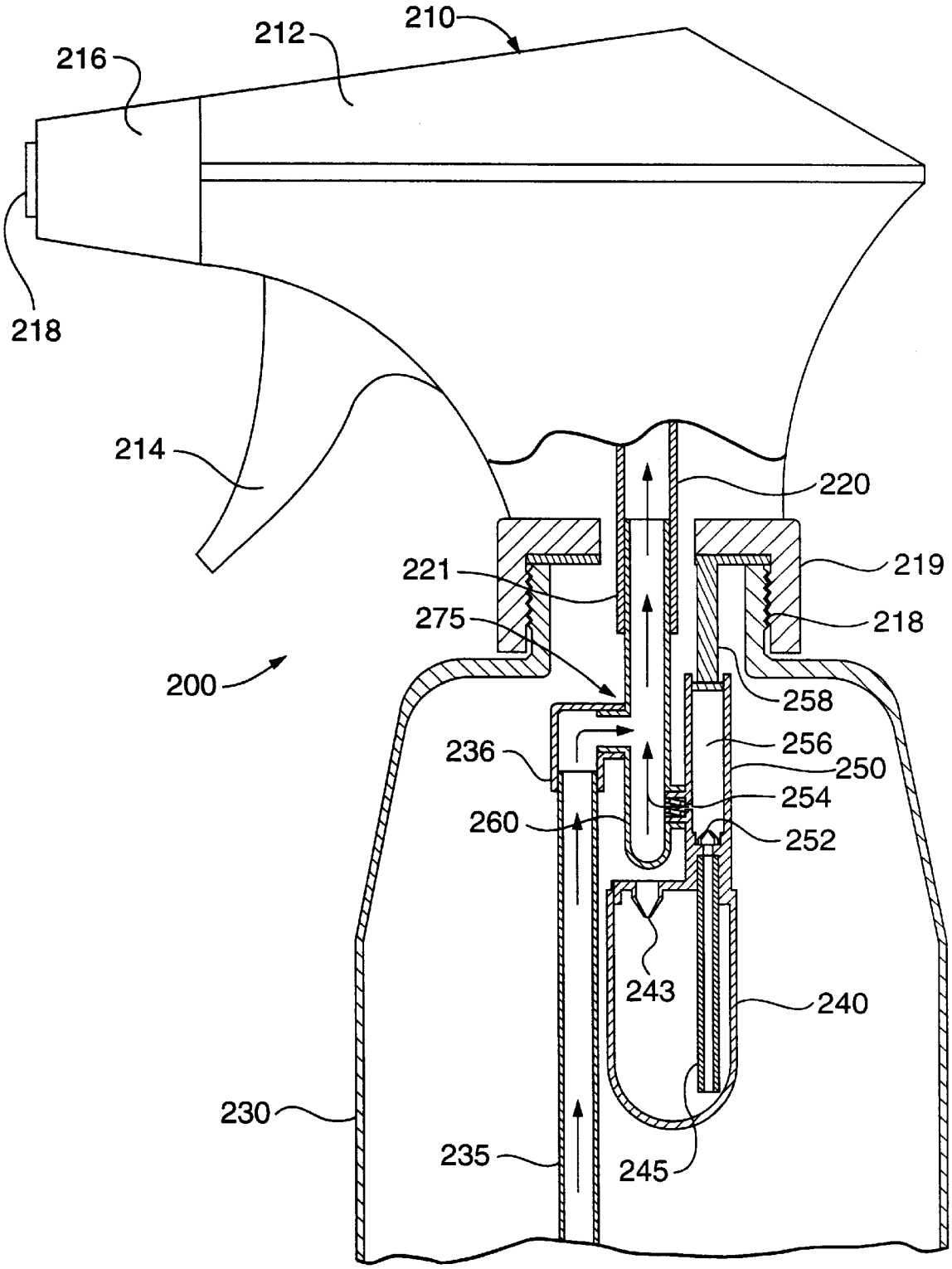
FIG. 3 is a partial cross-sectional view showing the components of a second embodiment of the dispensing assembly of the present invention.

FIG. 3 shows the components of a second embodiment of the dispensing assembly of the present invention. For the most part, the second embodiment is similar to the first embodiment, with the exception of the venting mechanism for the second container 240, in this case. Therefore, discussion will be limited to this difference.

Figure 5:
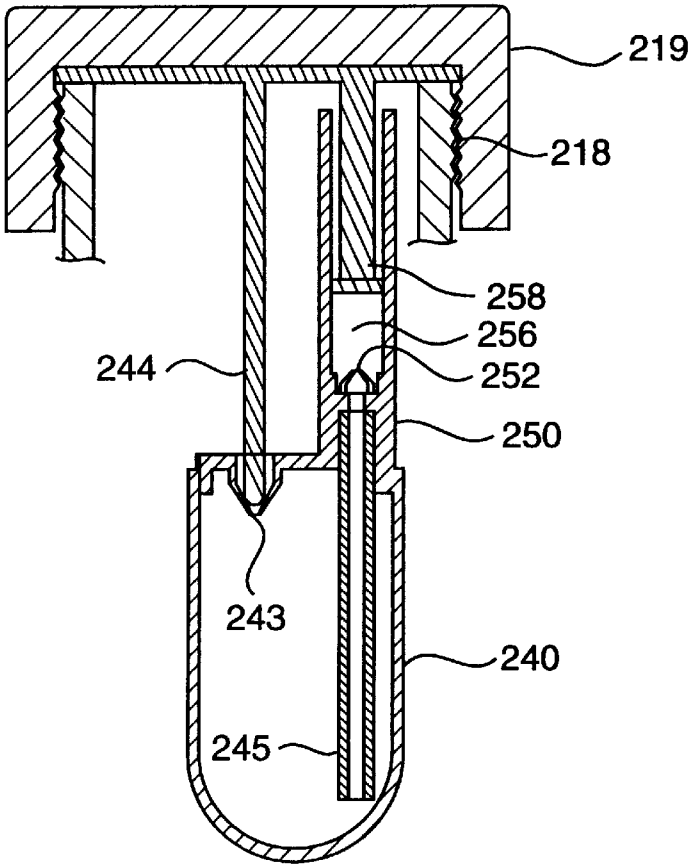
FIG. 5 is a partial cross-sectional view showing in more detail the components of the second embodiment of the dispensing assembly of the present invention, in the engaged position.
Figure 4:
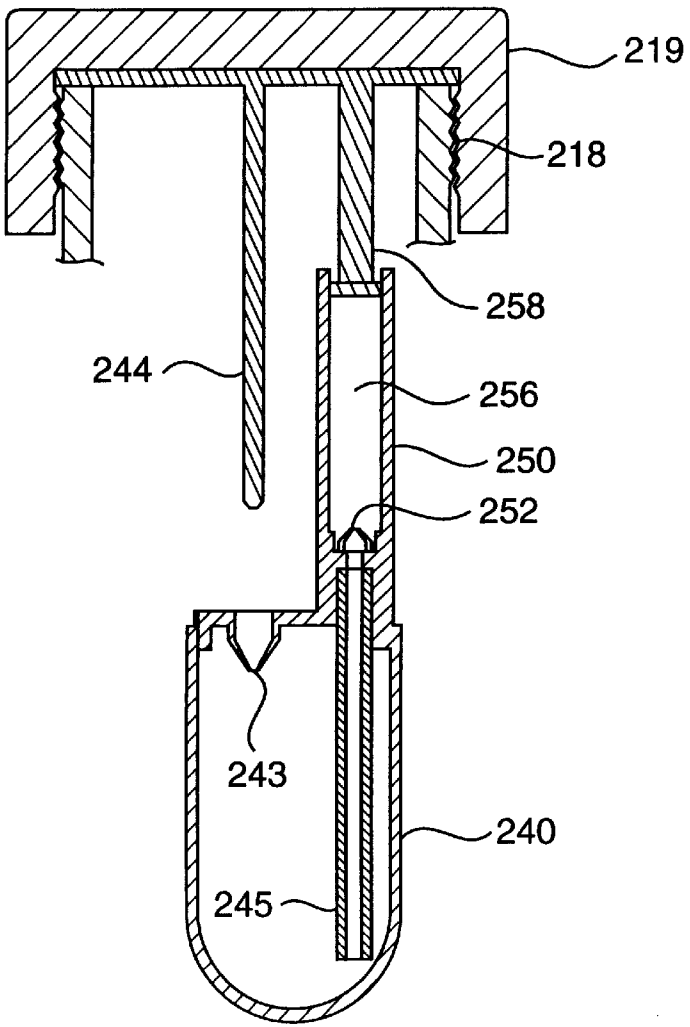
FIG. 4 is a partial cross-sectional view showing in more detail the components of the second embodiment of the dispensing assembly of the present invention.

FIG. 3 shows venting device 243 for second container 240, which includes a duckbill vent provided in an upper portion of the second container. As shown in FIGS. 4 and 5, a vent pin or rod 244 is affixed to the dispensing assembly 200, with the vent pin or rod 244 opening the duckbill vent 243 upon actuation of the pumping device 210. Of course, in this embodiment, it is necessary to offset the venting device 243 from the reciprocating conduit 220, in order to allow the vent pin or rod 244 unobstructed access to the duckbill vent 243 provided in the upper portion of the second container 240. This embodiment also provides instantaneous venting with a dispensing operation.

Preferred embodiments for providing an assembly for dispensing multiple fluids from nested containers, while simultaneously venting the fluid containers, have been discussed above. The present invention overcomes the above-noted drawbacks associated with the prior art, and provides such a dispensing system that achieves a stable ratio of dispensing fluids by means of a venting system that allows simultaneous, non-impeded venting of the containers to the atmosphere during pumping of fluid from the containers. The present invention also provides such a dispensing system that can be transported and stored without danger of leakage or evaporation of its contents, one that will dispense a mixture of two or more fluids in a specific and pre-set ratio and one that will prevent premature commingling or siphoning of the distinct fluids to be dispensed.

Other modifications of the dispensing assembly of the present invention for dispensing multiple fluids from nested containers, while simultaneously venting the fluid containers, will become apparent to those skilled in the art from an examination of the above patent specification and drawings. Therefore, other variations of the present invention may be made that fall within the scope of the following claims, even though such variations were not specifically discussed above.

INDUSTRIAL APPLICABILITY

The dispensing assembly of the present invention can be used whenever simultaneous dispensing of different and possibly incompatible fluids is desired. For example, one container might hold a fluid cleansing solution and the other a bleach, or one an aqueous stain removing formulation and the other a high solvent, enzyme-containing stain removing formulation. While convenience is a factor in dispensing two fluids from a single assembly, it has been found that the simultaneous dispensing of fluids having different properties and different active ingredients can provide performance superior to that of sequential application of the same fluids.

What we claim is:

1. An apparatus for dispensing a mixture of first and second fluids drawn from first and second containers, respectively, the apparatus being in combination with the containers, the apparatus comprising:

a first container for containing a first fluid;

a second container, nested within the first container, for containing a second fluid;

manually operable pumping means for pumping the first and second fluids from the first and second containers, respectively, to dispense a mixture of the fluids from the apparatus, the pumping means comprising (i) pump actuation means for actuating and deactuating the pumping means, (ii) a reciprocating fluid conduit, which is connected to the pump actuation means and reciprocates upon actuation and deactuation of the pumping means by the pump actuation means and (iii) a discharge nozzle, which is in fluid flow communication with the reciprocating fluid conduit for dispensing the mixture of the fluids from the apparatus upon actuation of the pumping means by the pump actuation means;

a fluid transfer channel in fluid flow communication with the reciprocating fluid conduit and providing a mixing chamber for mixing the first and second fluids drawn by the pumping means from the first and second containers, respectively;

a hollow fluid transfer dip tube for the first container, the first container dip tube being connected to the fluid transfer channel and extending into the first container for withdrawing the first fluid from the first container into the fluid transfer channel upon deactuation of the pumping means;

a hollow fluid transfer dip tube for the second container, the second container dip tube being in fluid flow communication with the fluid transfer channel and extending into the second container for withdrawing the second fluid from the second container upon deactuation of the pumping means; and an auxiliary pump having an auxiliary pump chamber, the auxiliary pump being connected to the reciprocating fluid conduit of the pumping means, and reciprocating upon a corresponding actuation and deactuation of the pumping means by the pump actuation means and being in fluid flow communication with the second container dip tube and the fluid transfer channel, wherein deactuation of the pumping means fills the auxiliary pump chamber with the second fluid drawn from the second container through the second container dip tube and actuation of the pumping means simultaneously supplies the fluid transfer channel with the second fluid from the auxiliary pump chamber and withdraws a mixture of the first and second fluids from the fluid transfer channel for dispensing the mixture of fluids from the apparatus through the discharge nozzle.

2. An apparatus according to claim 1, wherein the first container is vented to atmosphere upon actuation of said pumping means.

3. An apparatus according to claim 2, further comprising venting means for simultaneously venting the second container, when the first container is vented, upon actuation of said pumping means.

4. An apparatus according to claim 3, wherein said venting means comprises a flapper vent provided in an upper portion of the second container, the flapper vent being opened to vent the second container upon a corresponding venting operation of the first container.

5. An apparatus according to claim 3, wherein said venting means comprises a duck bill vent provided in an upper portion of the second container.

6. An apparatus according to claim 5, further comprising a vent pin affixed to said apparatus, the vent pin opening the duck bill vent upon actuation of said pumping means.

7. An apparatus according to claim 1, wherein the auxiliary pump further includes a stationary piston affixed to said apparatus, the piston being located within the auxiliary pump chamber such that reciprocation of the auxiliary pump upon a corresponding actuation and deactuation of the pumping means by the pump actuation means draws the second fluid from the second container into the auxiliary pump chamber and then pumps that fluid into the fluid transfer channel for mixing with the first fluid.

8. An apparatus according to claim 7, further comprising a one-way check valve located between the second container dip tube and the auxiliary pump chamber for allowing fluid flow of the second fluid from the second container, through the second container dip tube and into the auxiliary pump chamber.

9. An apparatus according to claim 7, further comprising a one-way check valve located between the auxiliary pump chamber and the fluid transfer channel for allowing fluid flow from the auxiliary pump chamber into the fluid transfer channel.

10. An apparatus according to claim 1, wherein the first fluid comprises a diluent and the second fluid comprises a concentrate, a mixture of which is dispensed from said apparatus in a predetermined ratio upon actuation of said pumping means.

11. An apparatus for dispensing a mixture of first and second fluids drawn from first and second containers, respectively, the apparatus being in combination with the containers, the apparatus comprising:

a first container for containing a first fluid;

a second container, nested within the first container, for containing a second fluid;

a manually operable pump for pumping the first and second fluids from the first and second containers, respectively, to dispense a mixture of the fluids from the apparatus, the pump comprising (i) a pump actuator for actuating and deactuating the pump, (ii) a reciprocating fluid conduit, which is connected to the pump actuator and reciprocates upon actuation and deactuation of the pump by the pump actuator and (iii) a discharge nozzle, which is in fluid flow communication with the reciprocating fluid conduit, for dispensing the mixture of the fluids from the apparatus upon actuation of the pump by the pump actuator;

a mixing chamber, in fluid flow communication with the reciprocating fluid conduit, for mixing the first and second fluids drawn by the pump from the first and second containers, respectively;

a fluid transfer conduit for withdrawing the first fluid from the first container into the mixing chamber; and a fluid transfer mechanism for withdrawing the second fluid from the second container into the mixing chamber, the fluid transfer mechanism including an auxiliary pump, attached to the reciprocating conduit, for pumping the second fluid from the second container to the mixing chamber upon a corresponding reciprocation of the reciprocating conduit, wherein deactuation of the pump fills the auxiliary pump with the second fluid drawn from the second container and actuation of the pump simultaneously supplies the mixing chamber with the second fluid from the auxiliary pump and withdraws a mixture of the first and second fluids from the mixing chamber for dispensing the mixture of fluids from the apparatus through the discharge nozzle.

12. An apparatus according to claim 11, wherein the first fluid is withdrawn from the first container into the mixing chamber upon deactuation of the pump.

13. An apparatus according to claim 11, wherein the second fluid is withdrawn from the second container upon deactuation of the pump.

14. An apparatus according to claim 11, wherein the fluid transfer mechanism further comprises a fluid transfer conduit for withdrawing fluid from the second container, and the auxiliary pump is in fluid flow communication with the second container fluid transfer conduit and the mixing chamber.

15. An apparatus according to claim 14, wherein the auxiliary pump includes an auxiliary pump chamber, and deactuation of the pump fills the auxiliary pump chamber with the second fluid drawn from the second container through the second container fluid transfer conduit and actuation of the pump simultaneously supplies the mixing chamber with the second fluid from the auxiliary pump chamber and withdraws a mixture of the first and second fluids from the mixing chamber for dispensing the mixture of fluids from the apparatus.

16. An apparatus according to claim 11, wherein the first container is vented to atmosphere upon actuation of the pump.

17. An apparatus according to claim 16, further comprising venting means for simultaneously venting the second container, when the first container is vented, upon actuation of the pump.

18. An apparatus according to claim 17, wherein said venting means comprises a flapper vent provided in an upper portion of the second container, the flapper vent being opened to vent the second container upon a corresponding venting operation of the first container.

19. An apparatus according to claim 17, wherein said venting means comprises a duck bill vent provided in an upper portion of the second container.

20. An apparatus according to claim 19, further comprising a vent pin affixed to said apparatus, the vent pin opening the duck bill vent upon actuation of the pump.

21. An apparatus according to claim 11, wherein the auxiliary pump further includes an auxiliary pump chamber and a stationary piston affixed to said apparatus, the piston being located within the auxiliary pump chamber such that reciprocation of the auxiliary pump upon a corresponding actuation and deactuation of the pump actuator draws the second fluid from the second container into the auxiliary pump chamber and then pumps that fluid into the fluid transfer channel for mixing with the first fluid.

22. An apparatus according to claim 21, further comprising a one-way check valve located between the second container and the auxiliary pump chamber for allowing fluid flow of the second fluid from the second container and into the auxiliary pump chamber.

23. An apparatus according to claim 21, further comprising a one-way check valve located between the auxiliary pump chamber and the mixing chamber for allowing fluid flow from the auxiliary pump chamber into the mixing chamber.

24. An apparatus according to claim 11, wherein the first fluid comprises a diluent and the second fluid comprises a concentrate, a mixture of which is dispensed from said apparatus in a predetermined ratio upon actuation of the pump.

* * * * *